US006284103B1

(12) United States Patent
Eng et al.

(10) Patent No.: US 6,284,103 B1
(45) Date of Patent: Sep. 4, 2001

(54) SUCTION ROLL SHELL IN A PAPER-MAKING MACHINE AND METHOD OF MANUFACTURING SAME

(75) Inventors: James A. Eng, Appleton; Peter T. Hunnicutt, Neenah; Edwin X. Graf, Menasha, all of WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/358,775

(22) Filed: Jul. 21, 1999

(51) Int. Cl.[7] ..... D21F 3/10
(52) U.S. Cl. ..... 162/372; 357/368
(58) Field of Search ..... 162/357, 372, 162/368, 373, 374; 29/895.211

(56) References Cited

U.S. PATENT DOCUMENTS 2,346,785 * 4/1944 Proulx ..... 162/374
3,097,995 * 7/1963 Beachler ..... 162/372
3,418,205 * 12/1968 Post ..... 162/372
3,447,451 * 6/1969 Meskanen ..... 162/372

FOREIGN PATENT DOCUMENTS

629633 * 9/1949 (GB) ..... 162/372
644594 * 10/1950 (GB) ..... 162/372

* cited by examiner

*Primary Examiner*—Karen M. Hastings
(74) *Attorney, Agent, or Firm*—Taylor & Aust, P.C.

(57) ABSTRACT

A method of manufacturing a suction roll shell for use in a paper-making machine utilizes a mandrel with a length and a cross-sectional area corresponding to the shell. The mandrel has a plurality of generally radially extending holes. A plurality of pins are placed in the holes, with each pin extending radially outward from the shell a distance greater than a desired thickness of the shell. At least one elongate fiber is wound around the mandrel to form the shell with the desired thickness. The pins are removed from the mandrel and the shell.

8 Claims, 2 Drawing Sheets

SUCTION ROLL SHELL IN A PAPER-MAKING MACHINE AND METHOD OF MANUFACTURING SAME

BACKGROUND OF THE INVENTION

1. Field of the Invention

The present invention relates to paper-making machines, and, more particularly, to suction rolls in such machines.

2. Description of the Related Art

A paper-making machine typically includes a plurality of rolls which carry a plurality of endless belts such that the fiber web is carried in a running direction from the wet end of the machine to the opposite end where a finished roll is produced. The paper-making machine may include one or more suction rolls placed at various longitudinal positions within the machine to draw moisture from a belt (such as a felt) and/or the fiber web. Each suction roll is typically constructed from a metallic shell with a plurality of holes extending radially therethrough. A vacuum pressure is drawn on the interior of the suction roll shell. Water is drawn through the radially extending holes and transported from the interior of the suction roll shell through appropriate fluid conduits or piping.

The shell of a suction roll is typically constructed of metal and the radially extending holes are formed using curling, laser cutting, etc. These machining processes physically remove the metal and may cause the formation of additional burrs, etc. which require additional machining operations to produce a shell surface with a smooth finish. Although effective, conventional suction roll shells are thus relatively time consuming and expensive to manufacture.

What is needed in the art is a suction roll shell and corresponding method of manufacturing which is less expensive to manufacture and produces a high quality shell.

SUMMARY OF THE INVENTION

The present invention provides a suction roll shell which is formed by wrapping carbon fiber tape around a mandrel with radially outwardly extending pins. The shell is formed easily, inexpensively and with minimal additional machining required.

The invention comprises, in one form thereof, a method of manufacturing a suction roll shell for use in a paper-making machine. A mandrel with a length and a cross-sectional area corresponding to the shell has a plurality of generally radially extending holes. A plurality of pins are placed in the holes, with each pin extending radially outward from the shell a distance greater than a desired thickness of the shell. At least one elongate fiber is wound around the mandrel to form the shell with the desired thickness. The pins are removed from the mandrel and the shell.

The invention comprises, in another form thereof, a paper-making machine for making a fiber web including a belt and a plurality of rolls. At least one of the rolls comprises a suction roll, with each suction roll having a shell with an inside surface and an outside surface. The shell has a plurality of holes therein extending from the inside surface to the outside surface. Each hole has an inlet at the outside surface and an outlet at the inside surface. Each hole has an inlet with a cross-sectional area which is substantially different than said corresponding outlet.

An advantage of the present invention is that the holes in the shell are formed without physically removing previously existing material during the manufacturing process.

Yet another advantage is that the strength characteristics of the shell may be more easily controlled by adjusting the number of layers of elongate fibers and/or wrap angles of the fibers from one layer to another.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
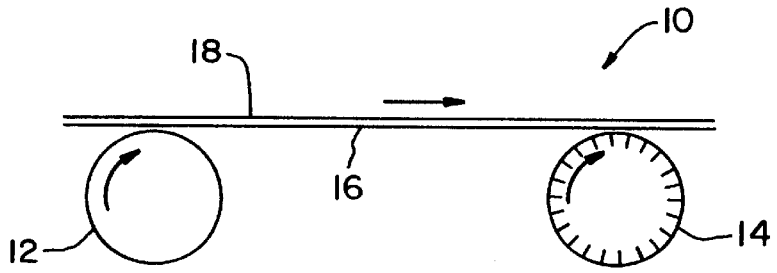
FIG. 1 is a partial, schematic representation of a paper-making machine of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown a schematic representation of an embodiment of a paper-making machine 10 of the present invention.

Paper-making machine 10 generally includes a plurality of rolls, such as rolls 12 and 14 which are assumed to rotate in the direction indicated, and which carry a belt 16 which supports a fiber web 18. The term "belt", as used herein, is generically referenced to indicate a traveling surface for supporting fiber web 18, such as a wire, felt or water impervious belt.

Paper-making machine 10 includes different kinds of rolls. One type of roll which is typically included therein is a suction roll 14, indicated schematically by the radially inwardly extending lines. Conventionally, a suction pressure is drawn on the interior of suction roll 14 and water is pulled through the plurality of radially extending holes to the interior of suction roll 14 where it is directed away in a longitudinal manner through appropriate fluid piping or conduits.

Figure 2:
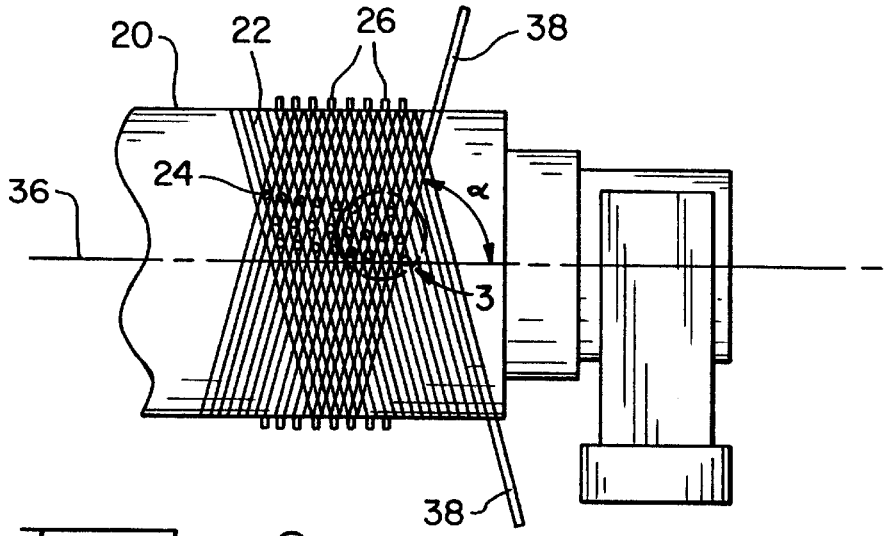
FIG. 2 is a fragmentary, side view of a portion of a mandrel used to manufacture an embodiment of a suction roll shell of the present invention.
Figure 3:
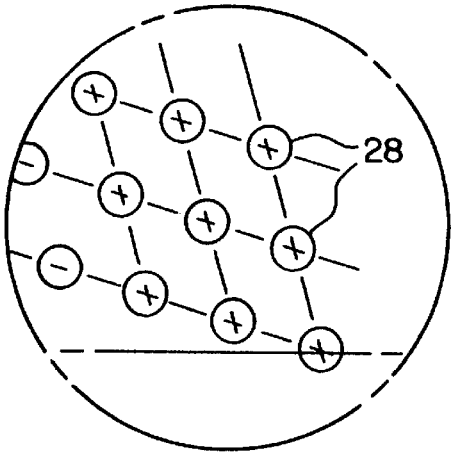
FIG. 3 is an enlarged view illustrating the hole pattern in the mandrel of FIG. 2.

FIGS. 2 and 3 illustrate an embodiment of a mandrel 20 which is used in a manufacturing process of the present invention for manufacturing a suction roll shell 22 to form part of suction roll 14. Mandrel 20 has a length in a longitudinal direction corresponding to the length of a suction roll 14 (e.g., the working width of paper-making machine 10). Mandrel 20 typically is constructed of metal, and may have a solid or hollow interior. To reduce the weight of mandrel 20 and thus the energy required to rotate mandrel 20, it is preferably made of a hollow construction. Mandrel 20 also includes a plurality of holes 24 which are formed therein and extend in a radially inward direction. The hole pattern of holes 24 may be of any suitable configuration, such as the embodiment shown in FIG. 3. Moreover, the diameter of holes 24 may be of any suitable configuration, corresponding to the vacuum pressure, etc. which is to be exerted within suction roll 14.

A plurality of pins 26 are placed within holes 24 in mandrel 20. Pins 26 extend radially outward from mandrel 20 a distance which is greater than a desired final thickness of shell 22. Pins 26 may have any suitable cross-sectional configuration. In the embodiment shown in FIGS. 1 and 2, pins 26 have a cylindrical configuration to define generally cylindrical holes 28 in the constructed shell 22 of suction roll 14.

Figure 4:
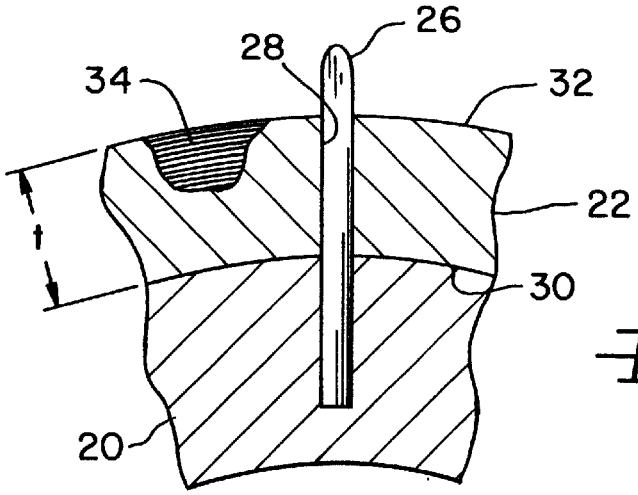
FIG. 4 is a side, fragmentary sectional view of an embodiment of a suction roll shell manufactured with the mandrel of FIG. 3.

Shell 22 (FIG. 4) has an inside surface 30 and an outside surface 32 defining a thickness t of shell 22 therebetween. Outside surface 32 carries fiber web 18; thus, each hole 18 includes an inlet at outside surface 32 and an outlet at inside surface 30. Shell 22 includes a plurality of fibers which are wound around mandrel 20 to define multiple layers 34 of the elongate fibers. Each layer includes elongate fibers which are disposed in generally parallel relationship to each other and at a wrap angle $\alpha$ relative to the longitudinal axis 36 of mandrel 20 and shell 22. The wrap angle $\alpha$ for the elongate fibers within a given layer 34 is preferably the same. However, the wrap angle between adjacent layers 34 preferably is different such that the tensile strength of shell 22 in the longitudinal, radial and hoop directions is increased. The wrap angel $\alpha$ may vary from a value of near zero in the event a circumferential wrap is utilized to a relatively small acute angle, depending upon the specific application with which shell 22 is utilized.

In the embodiment shown, the elongate fibers from which shell 22 is constructed are in the form of a tape including elongate fibers which are disposed in a side-by-side relationship relative to each other and held in place using a resin or plastic matrix or backing. The elongate fibers are preferably in the form of carbon fibers which have a high tensile strength. Other types of elongate fibers such as fiberglass, kevlar (™), etc. may be utilized.

During manufacture, pins 26 are placed within holes 24 of mandrel 20. Pins 26 extend in a radially outward direction form mandrel 20 a distance which is greater than a desired thickness of shell 22 to be formed thereon. Tape 38 is attached to mandrel 20 and mandrel 20 is rotated in a desired direction to wind tape 38 thereabout. The dispensing apparatus for tape 38 moves in a longitudinal direction of mandrel 20, concurrently with rotation of mandrel 20. Thus, a helical wrap around mandrel 20 with a predetermined wrap angle $\alpha$ defines a given layer 34 of shell 22. The rotational speed of mandrel 20 and the longitudinal feed direction of the tape dispenser define wrap angle $\alpha$. As the tape dispenser approaches the end of mandrel 20 and reaches the end of a layer 34 to be formed, the tape dispenser reverses feed direction at the same or a different longitudinal feed rate. A next layer 34 at the same or a different wrap angle $\alpha$ is thus formed over the previous layer 34. Each pin 26 has a slightly rounded upper end extending outward from mandrel 20 such that tape 38 is moved to a position adjacent thereto. The multiple layers are continuously built up on mandrel 20 until shell 22 has a desired thickness. As tape 38 is wound around mandrel 20, a suitable matrix such as a resin matrix or the like is also applied to tape 38 prior to application to mandrel 20. The matrix bonds the elongate fibers of shell 22 together. After shell 22 is formed with a desired thickness, pins 26 are removed from shell 22 in mandrel 20 such that holes 28 remain within shell 22. Shell 22 may then be removed from mandrel 20. An end cap is attached to shell 22 at each longitudinal end thereof to define suction roll 14 for use within paper making machine 10.

In the embodiment shown, mandrel 20 moves in a rotational direction and tape 38 is fed in a longitudinal direction using a tape dispenser. However, it is also possible to move tape 38 in both a longitudinal as well as a rotation direction around mandrel 20.

Figure 5:
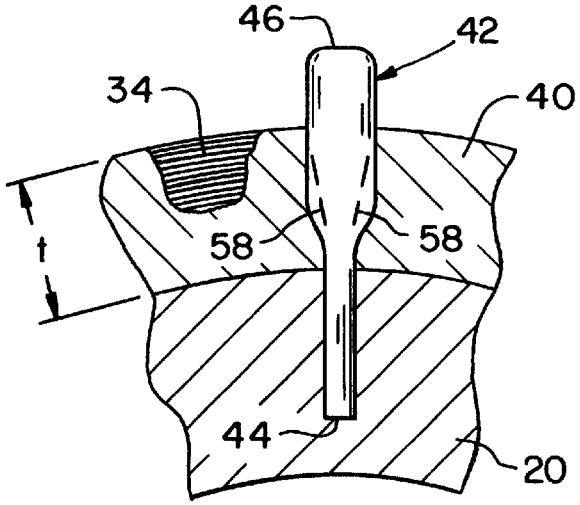
FIG. 5 is a side, fragmentary sectional view of another embodiment of a suction roll shell of the present invention.

FIG. 5 illustrates another embodiment of a shell 40 for a suction roll using mandrel 20 shown in FIG. 3. Pins 42 are placed within holes 24 of mandrel 20 in the same manner that pins 26 are placed therein in the embodiment shown in FIGS. 1–4. However, pins 42 have a cross-sectional shape which varies from one end 44 to an other end 46. More particularly, pins 42 have a compound curvature with a smaller end 44 being placed within a corresponding hole 24 and a larger end 46 extending past a desired thickness t of shell 40. After shell 40 is formed on mandrel 20 using tape 38, pins 42 are removed in an axial direction from shell 40 and mandrel 20. The larger end 46 which is formed in shell 40 in turn affects a larger area of fiber web 18 which is exposed to the vacuum pressure within shell 40.

Figure 6:
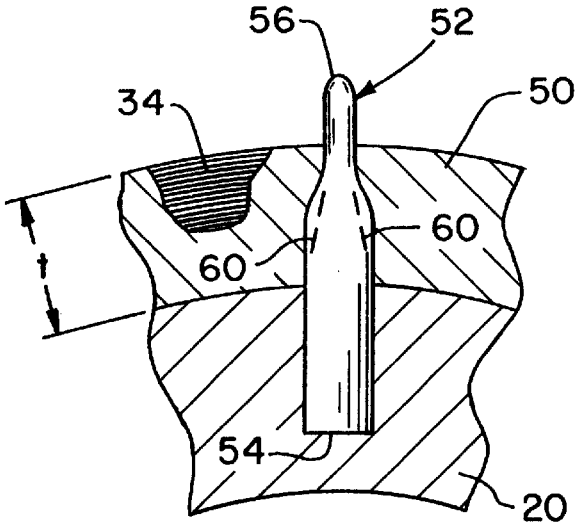
FIG. 6 is a side, fragmentary sectional view of yet another embodiment of a suction roll shell of the present invention.

FIG. 6 illustrates yet another embodiment of a shell 50 which is formed using mandrel 20. Pins 52 are inserted within mandrel 20, similar to pins 26 shown in FIGS. 1–4. Likewise, pins 52 have a compound curvature extending from an end 54 which is inserted within mandrel 20 to an end 56 which extends past the desired thickness of shell 50. However, in contrast with pins 42 shown in FIG. 5, pins 52 have an end 54 placed within mandrel 20 which is larger than an end 56 which extends past shell 50. It will of course be apparent that pins 52 can not be pulled in an axial direction from shell 50. Accordingly, it may be necessary to form pins 52 from a material with a relatively low melting point so that pins 52 can be removed therefrom. Alternatively, each pin 52 can be formed as a two-piece pin with a generally cylindrical core piece and a flared insert around the core piece which defines the larger diameter portion of end 54. Configured as such, the center core piece of each pin 52 is removed from mandrel 20, shell 50 is slid off of mandrel 20 in a longitudinal direction, and each flared insert is then removed in a radially inward direction from shell 50.

In the embodiment of shells 40 and 50 shown in FIGS. 5 and 6, pins 42 and 52, respectively, have a compound curvature. However, it is also possible to form pins 42 and 52 with a uniform taper (indicated by dashed lines 58 and 60) rather than a compound curvature.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper-making machine for making a fiber web, comprising:

a belt;

a plurality of rolls, at least one of said rolls comprising a suction roll, each said suction roll having a shell with an inside surface and an outside surface, said shell being comprised of a plurality of elongate fibers, said elongate fibers being wound to define a plurality of fiber layers, said shells having a plurality of holes therein extending form said inside surface to said outside surface, each said hole having an inlet at said outside surface and an outlet at said inside surface, each said hole having an inlet with a cross-sectional area which is substantially different than said corresponding outlet.

2. The paper-making machine of claim 1, wherein each said hole has an inlet with a cross-sectional area which is substantially larger than said corresponding outlet.

3. The paper-making machine of claim 2, wherein each said hole has an inlet and an outlet with a generally circular cross-sectional area.

4. The paper-making machine of claim 1, wherein each said hole has an inlet with a cross-sectional area which is substantially smaller than said corresponding outlet.

5. The paper-making machine of claim 4, wherein each said hole has an inlet and an outlet with a generally circular cross-sectional area.

6. The paper-making machine of claim 1, wherein said belt comprises one of a wire, felt and water impervious belt.

7. The paper-making machine of claim 1, wherein each said hole has an associated hole shape, at least one hole having a having a pin therein, each said pin having a pin shape, said pin shape being essentially the same as said hole shape.

8. The paper-making machine of claim 1, wherein each fiber layer has a wrap angle associated therewith, adjacent fiber layers having different wrap angles relative to each other.

* * * * *